US009463644B2

(12) United States Patent
Yamasaki

(10) Patent No.: US 9,463,644 B2
(45) Date of Patent: Oct. 11, 2016

(54) DRAWING APPARATUS AND DRAWING CONTROL METHOD THEREOF

(71) Applicant: CASIO COMPUTER CO., LTD., Tokyo (JP)

(72) Inventor: Shuichi Yamasaki, Fussa (JP)

(73) Assignee: CASIO COMPUTER CO., LTD, Tokyo (JP)

( * ) Notice: Subject to any disclaimer, the term of this patent is extended or adjusted under 35 U.S.C. 154(b) by 0 days.

(21) Appl. No.: 14/746,126

(22) Filed: Jun. 22, 2015

(65) Prior Publication Data

US 2015/0375548 A1 Dec. 31, 2015

(30) Foreign Application Priority Data

Jun. 30, 2014 (JP) ..... 2014-133917

(51) Int. Cl.
*B41J 3/407* (2006.01)
*A45D 29/00* (2006.01)
*B41J 29/38* (2006.01)

(52) U.S. Cl.
CPC ..... *B41J 3/4073* (2013.01); *B41J 3/407* (2013.01); *B41J 29/38* (2013.01); *A45D 2029/005* (2013.01)

(58) Field of Classification Search
CPC .... B41J 2/01; B41J 3/4073; A45D 2029/005
See application file for complete search history.

(56) References Cited

U.S. PATENT DOCUMENTS

2012/0274683 A1* 11/2012 Yamasaki ..... B41J 3/4073 347/2
2014/0063084 A1* 3/2014 Yamasaki ..... B41J 3/4073 347/3

FOREIGN PATENT DOCUMENTS

JP 2003-534083 A 11/2003

OTHER PUBLICATIONS

English Abstract of WO 01/91598 A1, dated Dec. 6, 2001.

* cited by examiner

*Primary Examiner* — Kristal Feggins
*Assistant Examiner* — Kendrick Liu
(74) *Attorney, Agent, or Firm* — Scully, Scott, Murphy & Presser, PC

(57) ABSTRACT

A drawing apparatus, including: a drawing data generation unit which, as a fitting process, fits a design image to a drawing region of a drawing target, and generates drawing data of the design image fitted to the drawing region; and a drawing unit which performs drawing of the design element on the drawing region on the basis of the drawing data, wherein the drawing region is curved along a width direction of the drawing region, the design image includes at least one design element, and the drawing data generation unit performs fitting the design element to a region excluding at least one edge portion from the drawing region, the edge portion being set on one side in a width direction of the drawing region.

8 Claims, 8 Drawing Sheets

DRAWING APPARATUS AND DRAWING CONTROL METHOD THEREOF

CROSS-REFERENCE TO RELATED APPLICATIONS

The entire disclosure of Japanese Patent. Application No. 2014-133917 filed on Jun. 30, 2014 including description, claims, drawings, and abstract are incorporated herein by reference in its entirety.

BACKGROUND OF THE INVENTION

1. Field of the Invention

The present invention relates to a drawing apparatus and a drawing control method thereof.

2. Description of Related Art

Conventionally, there have been known drawing apparatuses for nail print which print nail designs on nails. Such drawing apparatuses are described in Japanese Unexamined Patent Application Publication No. 2003-534083, for example. By using such apparatuses, nail designs can be enjoyed casually without visiting nail salons and such like.

As such drawing apparatuses, there have been known ink-jet type apparatuses which make ink be in the form of micro droplets and spray the ink droplets from print heads. On the other hand, it has been considered to adopt plot type apparatuses, as such drawing apparatuses, which include writing tools (pens) that perform drawing by making pen tips directly contact nail surfaces.

In a case where a plot type drawing apparatus is used, it is possible to use ink which has been difficult to use in the ink jet system, such as ink including pigment (color material) with a relatively large particle diameter and lame, ink with high viscosity, and such like. Thus, it is possible to achieve nail prints with finishes closer to nail arts provided at nail salons or the like.

However, nails which are printing targets for the nail print drawing apparatuses have curved shapes in which the central portions in the width direction are high and relatively flat and the portions closer to the both ends in the width direction are lower and inclined more.

Thus, in a case where the writing tool (pen) has a felt-like pen tip, a side of the pen tip sometimes contacts the nail at a largely inclined end portion in the width direction of the nail, and thus, the drawing line becomes thicker. In a case where the writing tool has a pen tip which is a ballpoint pen type, the ball part of the pen tip sometimes cannot contact the nail surface sufficiently at a largely inclined end portion in the width direction of the nail, and thus, the line blurs or becomes broken, and the drawing cannot be performed successfully. Thus, designers need to create designs in consideration of the difference between the central portion and the both end portions in the width direction of a nail, which has been troublesome work.

SUMMARY OF THE INVENTION

An object of the present invention is to facilitate design creation not requiring consideration of the difference between the central portion and the both end portions in the width direction of the nail.

In order to solve the above object, according to one aspect of the present invention, there is provided a drawing apparatus, including: a drawing data generation unit which, as a fitting process, fits a design image to a drawing region of a drawing target, and generates drawing data of the design image fitted to the drawing region; and a drawing unit which performs drawing of the design image on the drawing region on the basis of the drawing data, wherein the drawing region is curved along a width direction of the drawing region, the design image includes at least one design element; and the drawing data generation unit, in the fitting process, fits the design element to a region excluding at least one edge portion from the drawing region, the edge portion being set on one side in the width direction of the drawing region.

According to another aspect of the present invention, there is provided a drawing control method of a drawing apparatus, the method comprising: generating drawing data of a design image by fitting the design image to a drawing region of a drawing target; and drawing the design element on the drawing region on the basis of the generated drawing data, wherein the drawing region is curved along a width direction of the drawing region, the design image includes at least one design element; and the generating of the drawing data includes first fitting that is fitting the design element to a region obtained by excluding at least one edge portion from the drawing region, the edge portion being set on one side in the width direction of the drawing region.

BRIEF DESCRIPTION OF THE DRAWINGS

The above and other objects, advantages and features of the present invention will become more fully understood from the detailed description given hereinafter and the appended drawings which are given by way of illustration only, and thus are not intended as a definition of the limits of the present invention, and wherein.

DETAILED DESCRIPTION OF THE PREFERRED EMBODIMENT

Figure 1:
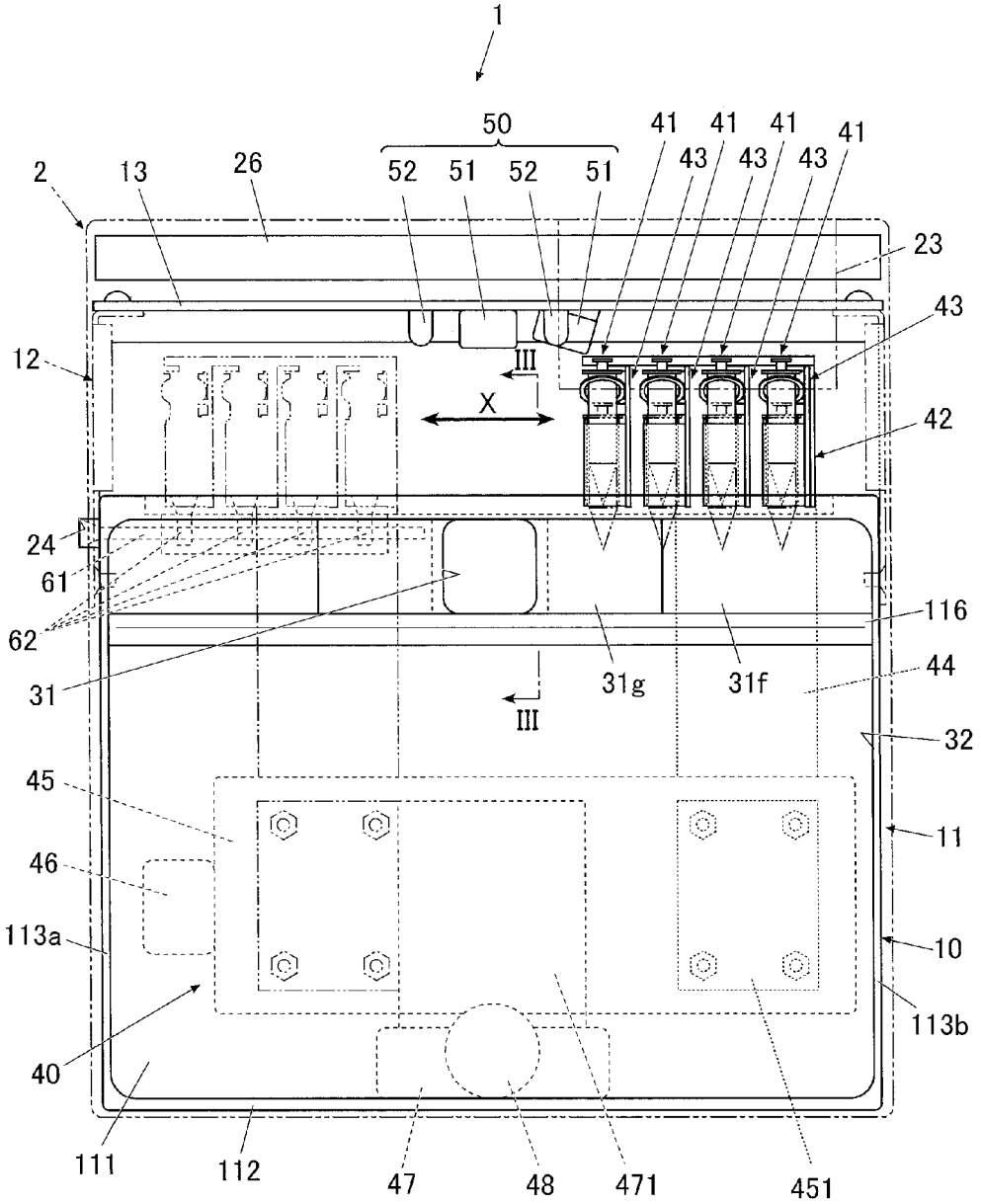
FIG. 1 is a front view of a drawing apparatus according to an embodiment.

Hereinafter, an embodiment of a drawing apparatus according to the present invention will be described in detail by showing the drawings. However, the scope of the present invention is not limited to the illustrated examples.

In the following embodiment, the drawing apparatus performs drawing on a fingernail of a hand as a drawing target. However, the drawing target of the present invention is not limited to the fingernail of hand. The drawing target may be a nail of a toe, for example.

FIG. 1 is a front view of the drawing apparatus.

Figure 2:
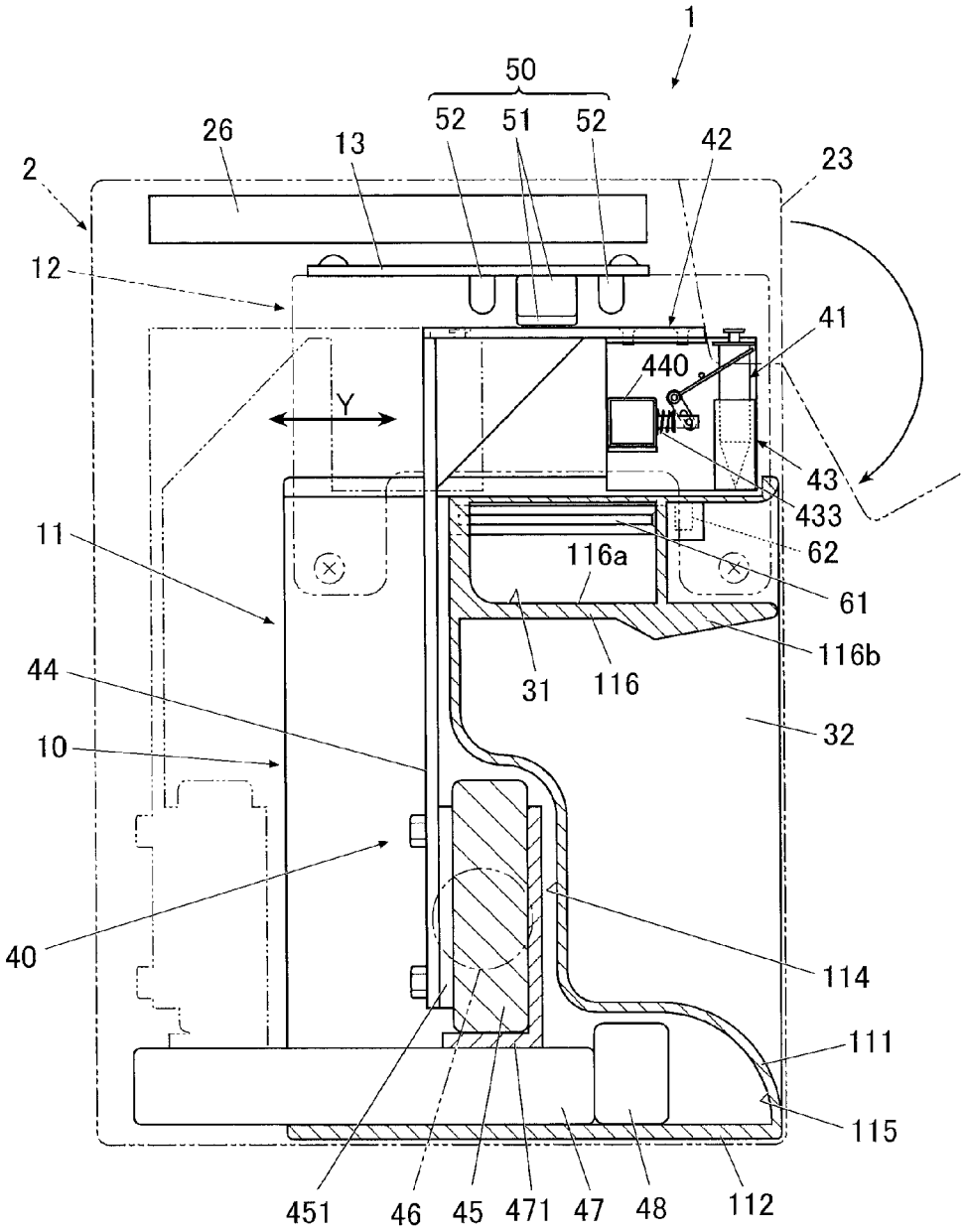
FIG. 2 is a lateral view showing an internal structure by a cross section of a portion of the drawing apparatus shown in FIG. 1.

FIG. 2 is a lateral view showing an internal configuration by a cross section of a portion of the drawing apparatus shown in FIG. 1.

As shown in FIGS. 1 and 2, the drawing apparatus 1 is a plot type and includes a case main body 2 and an apparatus main body 10 contained in the case main body 2. In FIGS. 1 and 2, the case main body 2 is shown by a two-dot chain line.

A writing tool replacement cover 23 which is configured to be openable and closable for replacing an after-mentioned writing tool 41 such as a pen in a drawing unit 40 is provided at an end of the upper section on the front surface of the case main body 2. The writing tool replacement cover 23 is rotatable from a closed state to an open state via a hinge or the like as shown in FIG. 2, for example.

Further, at the position on a lateral surface (left lateral surface in FIG. 1 in the embodiment) of the case main body 2 corresponding to an after-mentioned writing tool test writing unit 61, there is provided a medium inserting port 24 through which a drawing medium (not shown in the drawings) to be placed on the writing tool test writing unit 61 can be replaced.

An operation unit 25 (see FIG. 4) is set on the upper surface (top plate) of the case main body 2.

The operation unit 25 is an input unit for performing various input by a user.

The operation unit 25 is provided with a power switch button to turn on the drawing apparatus 1, a stop switch button to stop an operation, a design selection button to select a design image to be drawn on a nail T, a drawing start button to instruct start of drawing and operation buttons (not shown in the drawings) for performing various types of input, for example.

A display unit 26 is set at a nearly central portion of the upper surface (top plate) of the case main body 2.

The display unit 26 is configured by including a liquid crystal display (LCD: Liquid Crystal Display), an organic electroluminescent display and other flat display, for example.

In the embodiment, on the display unit 26, a nail image (finger image including an image of a nail T) obtained by photographing a printing finger U1, an image such as the outline of the nail T included in the nail image, a design selection screen for selecting a design image to be drawn on the nail T, thumbnail images for design confirmation and instruction screens for displaying various instructions are appropriately displayed, for example.

A touch panel may be integrally formed on the surface of the display unit 26. In such case, for example, various types of selection and instruction can be performed by touching the touch panel surface with a fingertip or the like. Various types of input can be carried out also by tools other than fingers, for example, by a touching operation of touching the surface of the display unit 26 with a stylus pen or a writing tool of sharpened stick.

The apparatus main body 10 is formed in a nearly box shape and includes a lower machine casing 11 which is set at the lower section in the case main body 2 and an upper machine casing 12 which is set above the lower machine casing 11 and at the upper section in the case main body 2.

First, the lower machine casing 11 will be described.

The lower machine casing 11 includes a back surface board 111, a bottom board 112, a horizontal pair of side boards 113*a* and 113*b*, an X-direction movement stage containing unit 114, a Y-direction movement stage containing unit 115 and a dividing wall 116.

The lower ends of the side boards 113*a* and 113*b* are connected to the left and right end portions of the bottom board 112, respectively, and the side boards 113*a* and 113*b* are vertically provided with respect to the bottom board 112.

As shown in FIG. 2, the lower portion of the back surface board 111 is formed to be concave in two steps toward the front side (front side in the finger inserting direction). The lower end portion of the back surface board 111 is connected to the front end portion of the bottom board 112, and the back surface board 111 divides a region, which is surrounded by the bottom board 112 and the side boards 113*a* and 113*b*, back and forth.

The X-direction movement stage containing unit 114 and the Y-direction movement stage containing unit 115 are formed back from the concave back surface board 111 (see FIG. 2).

In the X-direction movement stage containing unit 114, an X-direction movement stage 45 of a drawing unit 40 is contained when the drawing unit 40 is moved forward (toward the front side of the finger inserting direction).

A Y-direction movement stage 47 of the drawing unit 40 is disposed in the Y-direction movement stage containing unit 115.

The dividing wall 116 is provided inside the lower machine casing 11 so as to vertically divide a space at the front side inside the lower machine casing 11 (space at the front side of the finger inserting direction which is surrounded by the back surface board 111, bottom board 112 and the side boards 113*a* and 113*b*).

The dividing wall 116 is provided to be nearly horizontal. The lateral end portions of the dividing wall 116 are connected to the side boards 113*a* and 113*b*, respectively, and the rear end portion of the dividing wall 116 is connected to the back surface board 111.

A finger fixing unit 30 is integrally provided in the lower machine casing 11.

The finger fixing unit 30 will be described with reference to FIG. 3.

Figure 3:
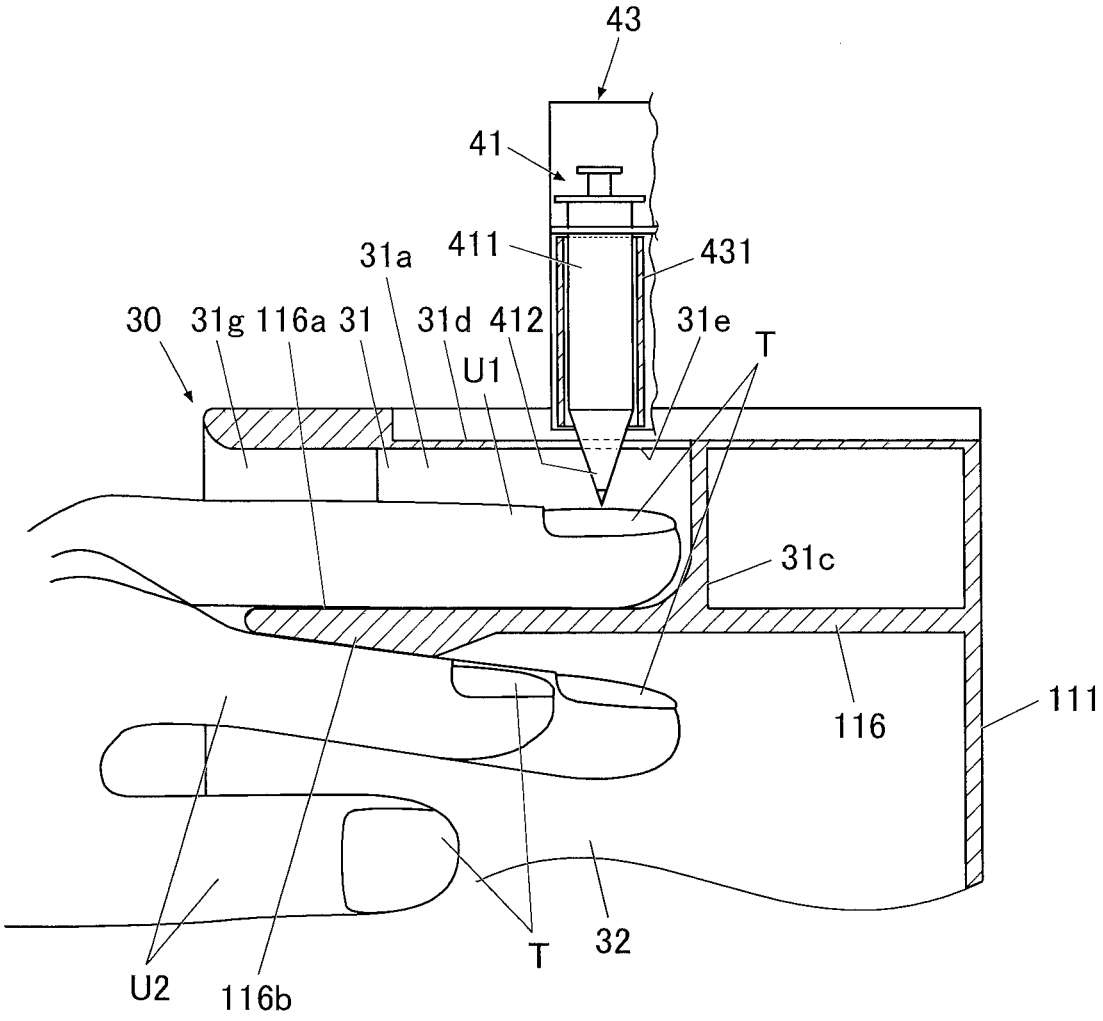
FIG. 3 is a sectional view showing a cross section along the line shown in FIG. 1 seen from the arrow direction.

FIG. 3 is a sectional view showing the cross section along the line shown in FIG. 1 seen from the arrow direction.

The finger fixing unit 30 is configured by including a finger receiving unit 31 which receives a finger (hereinafter, called "printing finger U1") corresponding to the nail T to perform drawing and a finger resting unit 32 in which fingers (hereinafter, called "non-printing fingers U2") other than the printing finger U1 rests.

The finger receiving unit 31 is disposed at a nearly central portion in the width direction of the lower machine casing 11 on the upper side of the dividing wall 116.

The space divided by the dividing wall 116 to be lower side of the lower machine casing 11 forms the finger resting unit 32.

For example, in a case where drawing is to be performed on a nail T of a ring finger, as shown in FIG. 3, the ring finger as the printing finger U1 is inserted into the finger receiving unit 31 and the other four fingers (thumb, index finger, middle finger and little finger) which are non-printing fingers U2 are inserted into the finger resting unit 32.

The finger receiving unit 31 is open at the front surface side (front side in the printing finger insertion direction) of the lower machine casing 11, and the finger receiving unit 31 is defined at the lower side by a finger placement unit 116*a* forming a part of the dividing wall 116, and defined by dividers 31*a* and 31*b* at both lateral sides and by a divider 31*c* at the back side. The finger placement unit 116*a* is for placing the finger (printing finger U1) of the nail T to perform drawing on the X-Y plane.

The upper side of the finger receiving unit 31 is defined by a roof 31*d*. A window 31*e* for exposing the nail T of the printing finger U1 inserted into the finger receiving unit 31 is formed in the roof 31*d*.

A front wall 31*f* (see FIG. 1) which covers the front surface side of the lower machine casing 11 is vertically provided at each of the lateral portions of the front surface side of the lower machine casing 11 on the upper surface of the dividing wall 116.

On the upper surface of the dividing wall 116, a pair of guide walls 31*g* is vertically provided, the guide walls 31*g* being narrowing toward the finger receiving unit 31 from the end portions of the front walls 31*f* which are near the central portion and guiding the printing finger U1 into the finger receiving unit 31.

The user can sandwich the dividing wall 116 between the printing finger U1 inserted into the finger receiving unit 31 and the non-printing fingers U2 inserted into the finger resting unit 32. Thus, the printing finger U1 inserted into the finger receiving unit 31 is fixed stably.

In the embodiment, a protrusion 116*b* protruding downward is formed at the front end portion of the dividing wall 116. The protrusion 116*b* may be a tapered portion which gradually becomes thinner toward the front side and gradually becomes thicker toward the back side, for example. Alternatively, the entire protrusion 116*b* may be thick with respect to the concave at the back side of the dividing wall 116. By forming the protrusion 116*b* at the front end portion of the dividing wall 116, when the non-printing fingers U2 are inserted into the finger resting unit 32, a space is secured between the nails T of the fingers on which drawing is already performed and the dividing wall 116. Thus, it is possible to prevent ink from attaching to the apparatus due to the contact of the nails T with the lower surface of the dividing wall 116 and prevent pictures drawn on the nail T from blurring to be damaged.

Next to the finger receiving unit 31 (the position corresponding to the medium inserting port 24 of the case main body 2, and the left side in FIG. 1 in the embodiment) on the upper surface of the dividing wall 116, the writing tool test writing unit 61 for after-mentioned test writing of a writing tool 41 is provided within a range enabling drawing by an after-mentioned print head 42. It is preferable that the writing tool test writing unit 61 is provided so as to be nearly as high as the nail T when the printing finger U1 is inserted into the finger receiving unit 31.

The writing tool test writing unit 61 has a configuration in which a flat plate-like drawing medium inserted through the medium inserting port 24 of the above-mentioned case main body 2 is placed.

The drawing medium to be placed on the writing tool test writing unit 61 may be anything as long as it allows conditioning of a pen tip 412. The drawing medium is a sheet of paper, for example.

The writing tool test writing unit 61 is for improving the condition of the pen tip 412 by lowering the writing tool 41 onto the drawing medium and drawing a predetermined image such as "○" and "∞" to perform test writing before starting the drawing based on image data on the nail T in order to prevent the blur of ink at the start of drawing due to a dry pen tip 412, poor ink application and such like. Though the predetermined image to be drawn at the test writing is not especially limited, a preferable one is a simple figure such as "○" and "∞" so as not to waste too much ink. It is preferable to draw the figure such as "○" and "∞" by gradually shifting the position within the range of the writing tool test writing unit 61 every time the test writing is performed. When the test writing has been performed on the nearly entire surface of the drawing medium, a display screen such as "replace sheet" which requires replacement of the drawing medium is displayed on the display unit 26. In such case, by the user removing the drawing medium from the medium inserting port 24 to replace it with a new one, test writing becomes possible on the new drawing medium. In a case where the drawing medium is a roll of paper, when there is no drawing space left, the roll of paper is wheeled to feed a drawing medium and test writing becomes possible on a new drawing surface.

In the embodiment, writing tool caps 62 made of rubber are set in front (front side of the finger inserting direction) of the writing tool test writing unit 61. The number of the provided writing tool caps 62 (four in the embodiment) corresponds to the writing tools 41 set in the drawing unit 40. After setting the writing tools 41 in the drawing unit 40 and while drawing is not performed (non-drawing time), the writing tools 41 are contained in the writing tool caps 62. The region where the writing tool caps 62 and such like are disposed is the home space where the writing tools 41 standby during the non-drawing time.

That is, during the non-drawing time, the writing tools 41 are moved to be directly above the writing tool caps 62, and thereafter the writing tools 41 are lowered by after-mentioned solenoids 440, and the pen tips 412 are contained in the respective writing tool caps 62. Thereby, the pen tips 412 can be prevented from drying during the non-drawing time. The shapes and such like of the writing tool caps 62 are not limited to the illustrated example. For example, the writing tool caps 62 may be a long groove-like writing tool cap which can receive the pen tips 412 of all the writing tools 41 set in the drawing unit 40.

In the embodiment, since the writing tool caps 62 are provided near the writing tool test writing unit 61 in such way, drawing can be started by elevating a writing tool 41 to perform test writing in the writing tool test writing unit 61 which is close to the writing tool caps 62. Thus, it is possible to minimize the time required for moving the writing tool 41 and such like and perform the drawing operation rapidly.

The drawing unit 40 performs drawing on nails on the basis of image data of a selected design image by using a plurality of types of ink, and includes the print head 42 which includes writing tools 41, a unit supporting member 44 which supports the print head 42, the X-direction movement stage 45 for moving the print head 42 in the X direction (X direction in FIG. 1, horizontal direction of the drawing apparatus 1), an X-direction movement motor 46, the Y-direction movement stage 47 for moving the print head 42 in the Y direction (Y direction in FIG. 2, front-back direction of the drawing apparatus 1), a Y-direction movement motor 48 and such like.

In the embodiment, the print head 42 includes four writing tool carriages 43 each of which holds a single writing tool 41.

The writing tool 41 which is a drawing tool performs drawing by applying ink to the surface of nail T.

Each of the writing tools (drawing tools) 41 held by the writing tool carriages 43 is provided with the pen tip 412 at the one end of a pen shaft 411. The inside of the pen shaft 411 is an ink containing unit which contains various types of ink. The ink to be contained inside the pen shaft 411 is not especially limited in viscosity and particle diameter (size of particle) of a color material and such like. As the ink, ink including gold and silver lame, white ink, ultraviolet curable ink, and ink for gel nail, undercoat, topcoat and manicure can also be used, for example.

The writing tool 41 is, for example, a pen which has a pen tip 412 of a ballpoint pen type and performs drawing by the pen tip 412 being pressed against the surface of the nail T and the ink contained in the pen shaft 411 being applied to the surface of the nail T. The writing tool 41 is not limited to the ballpoint pen type. The writing tool 41 may also be a felt pen type which performs drawing with ink sinking through the felt-like pen tip or a calligraphy pen type which performs drawing with ink sinking through a tied brush, for example. Pen tips 412 having various types of thickness and shapes can also be prepared.

The plurality of writing tools 41 to be held by the writing tool carriages 43 may have the pen tips 412 of a same type or may have different types of pen tips 412.

In the embodiment, four writing tool carriages 43 holding the writing tools 41 are aligned in the width direction (lateral direction, X-direction in FIG. 1) of the apparatus. Thus, the positions of the pen tips 412 of the writing tools 41 are shifted from each other in the X-direction (lateral direction of the apparatus). The amount of shift is an integral multiple of one step in the drawing operation, and the drawing is performed by correcting the position in X direction for the number of steps corresponding to the amount of the shift according to each of the writing tools 41 used for the drawing. Thus, the four writing tools 41 can perform drawing at the same position.

Each of the writing tool carriages 43 is provided with a writing tool holder 431 as a drawing tool holder which nearly vertically holds the writing tool 41.

The writing tool holder 431 moves the writing tool 41 up and down by cooperation between the spring 433 and solenoid 440 while holding the writing tool 41 nearly vertically.

Specifically, when the solenoid 440 is driven, the writing tool 41 is lowered against the biasing force of spring 433 and is able to contact the nail T surface or the drawing medium as a drawing target, which is a drawing state. On the other hand, when the solenoid 440 is released, the writing tool 41 is moved up by the biasing force of spring 433 and does not contact the nail T surface or the drawing medium, which is a non-drawing state.

In the embodiment, the solenoid 440 is used as an actuator for moving the writing tool 41 up and down. However, the actuator for moving the writing tool 41 vertically is not limited to the solenoid 440. Since the writing tool 41 is light, the actuator for moving the writing tool 41 vertically can be formed by various types of compact driving devices as well as the solenoid.

The unit supporting member 44 which supports the print head 42 is fixed to the X-direction movement unit 451 which is attached to the X-direction movement stage 45.

The X-direction movement unit 451 is moved in the X-direction along the guide which is not shown in the drawings on the X-direction movement stage 45 by the drive of the X-direction movement motor 46. Thus, the print head 42 is moved in the X-direction (X-direction in FIG. 1, lateral direction of the drawing apparatus 1).

The X-direction movement stage 45 is fixed to the Y-direction movement unit 471 of the Y-direction movement stage 47.

The Y-direction movement unit 471 is moved in the Y-direction along the guide which is not shown in the drawings on the Y-direction movement stage 47 by the drive of the Y-direction movement motor 48. Thus, the print head 42 is moved in the Y-direction (Y-direction in FIG. 2, front-back direction of the drawing apparatus 1).

In the embodiment, the X-direction movement stage 45 and the Y-direction movement stage 47 are formed by combining the X-direction movement motor 46 and the Y-direction movement motor 48, and ball screws and guides which are not shown in the drawings. As the X-direction movement motor 46 and the Y-direction movement motor 48 in the embodiment, a stepping motor which moves for a predetermined amount every time a single pulse is transmitted is applied.

In the embodiment, a head driving unit 49 (see FIG. 4) which drives the print head 42 including the writing tools 41 that perform drawing on the nail T in X-direction and Y-direction is formed by the X-direction movement motor 46, the Y-direction movement motor 48 and such like.

The solenoids 440, the X-direction movement motor 46 and the Y-direction movement motor 48 in the drawing unit 40 for moving the writing tools 41 up and down are connected to a drawing control unit 815 (see FIG. 4) of an after-mentioned control device 80 and controlled by the drawing control unit 815.

As shown in FIGS. 1 and 2, a photographing unit 50 is provided on the upper machine casing 12.

That is, a substrate 13 is set on the upper machine casing 12, and two cameras 51 as a photographing device are set at the central portion of the lower surface of the substrate 13. It is preferable that each of the cameras 51 has approximately two million pixels or more, for example.

Each of the cameras 51 photographs the nail T of the printing finger U1 inserted into the finger inserting unit 31 and obtains a nail image (finger image including an image of nail T) which is an image of nail T of the printing finger U1.

In the embodiment, the two cameras 51 are provided so as to be nearly parallel to each other in the width direction of the nail T of the printing finger U1 inserted into the printing finger receiving unit 31. Among the two cameras 51, one camera 51 is provided so as to face to the bottom surface of the finger receiving unit 31 and photograph the nail T from directly above. The other camera 51 is provided so as to be slightly inclined with respect to the bottom surface of the finger receiving unit 31 and photograph the nail T obliquely from above.

On the substrate 13, lights (lighting device) 52 such as white LEDs are set so as to surround the cameras 51. The lights 52 illuminate the nail T of the printing finger U1 at photographing by the cameras 51. The photographing unit 50 is configured by including the cameras 51 and the lights 52.

The photographing unit 50 is connected to an after-mentioned photographing control unit 811 (see FIG. 4) in the control device 80 and controlled by the photographing control unit 811.

Image data of the image obtained by the photographing unit 50 is stored in a nail image storage area 821 of an after-mentioned storage unit 82.

In the embodiment, the nail T is photographed from at least two different positions or angles by the two cameras 51 as the photographing device, and at least two nail images are obtained.

Then, on the basis of the nail images, an after-mentioned nail information detecting unit 812 can detect nail information such as the inclination angle (hereinafter, called "inclination angle of nail T" or "nail curvature") with respect to the X-Y plane of the nail T surface and a vertical position of nail T in addition to the outline (shape of nail T) of nail T. That is, the nail T which is the drawing target has a shape curved along the width direction at drawing. Thus, for example, by obtaining the image of nail T from directly above and the image of nail T obliquely from above, it is possible to accurately detect the position and the inclination angle due to the curvature of nail T surface in addition to the outline of nail T.

The configuration including two cameras 51 as the photographing device so as to be able to detect the inclination angle or nail curvature of nail T is not an essential configuration, and only a single camera 51 may be provided so as to photograph the nail T only from above to detect the outline of nail T (shape of nail T) as the nail information.

The control device 80 is set on the substrate 13 or such like disposed on the upper machine casing 12, for example.

Figure 4:
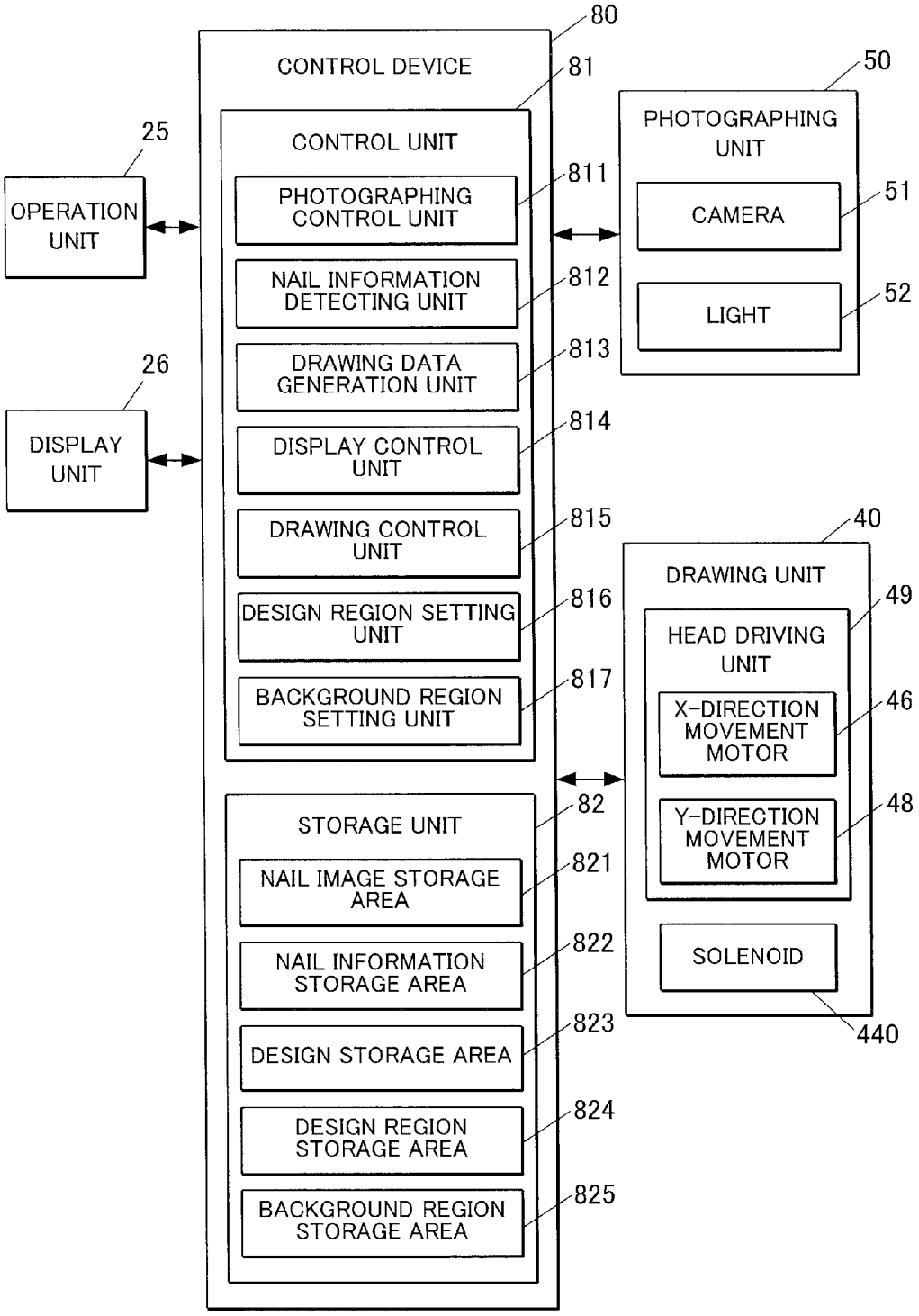
FIG. 4 is a main part block diagram showing a control structure according to the embodiment.

FIG. 4 is a main part block diagram showing a control structure in the embodiment.

As shown in FIG. 4, the control device 80 is a computer which includes a control unit 81 having a CPU (Central Processing Unit) and the storage unit 82 having a ROM (Read only memory), a RAM (Random access memory) and such like.

Various programs for operating the drawing apparatus 1 and various data are stored in the storage unit 82.

Specifically, in the ROM of the storage unit 82, various programs such as a nail information detecting program for detecting nail information such as the shape, position and curvature of the nail T from the nail image, a print data generation program for generating print data, and a printing program for performing printing are stored. The control device 80 executes the programs to integrally control the units of the drawing apparatus 1.

In the embodiment, the storage unit 82 is provided with a nail image storage area 821 for storing a nail image of the nail T of the printing finger U1 of the user obtained by the photographing unit 50, a nail information storage area 822 for storing the nail information detected by the nail information detecting unit 812, a design storage area 823 for storing image data of a design image to be printed on the nail T, a design region storage area 824 for storing a design region which is set by a design region setting unit 816, and a background region storage area 825 for storing a background region which is set by a background region setting unit 817.

The image data includes a design element D1 and a background design D2 which is the background of the design element D1 (see FIG. 6).

In a functional view, the control unit 81 includes the photographing control unit 811, the nail information detecting unit 812, the drawing data generation unit 813, the display control unit 814, the drawing control unit 815, the design region setting unit 816 and such like. The functions as the photographing control unit 811, the nail information detecting unit 812, the drawing data generation unit 813, the display control unit 814, the drawing control unit 815, the design region setting unit 816, the background region setting unit 817 and such like are achieved in cooperation between the CPU of the control unit 81 and the programs stored in the ROM of the storage unit 82.

The photographing control unit 811 controls the cameras 51 and the lights 52 of the photographing unit 50 to photograph images of the nail T of the printing finger U1 inserted into the finger receiving unit 31 with the cameras 51.

In the embodiment, the photographing control unit 811 obtains images of nail T by controlling the cameras 51 and the lights 52 of the photographing unit 50 to photograph the nail T of the printing finger U1.

The nail information detecting unit 812 detects the nail information for the nail T of the printing finger U1 on the basis of the images of the nail T of the printing finger U1 photographed by the cameras 51.

Here, the nail information includes the outline of the nail T (the nail shape and horizontal position of the nail T), the height of the nail T (location in the vertical direction of the nail T, hereinafter, called "vertical position of the nail T" or simply called "position of the nail T") and curvature of nail T (nail curvature), and the nail information detecting unit 812 detects the shape, position and curvature of the nail T as the nail information. Here, the entire region defined by the outline of nail T is called a nail region (drawing region).

Specifically, the nail information detecting unit 812 detects the outline (shape and size) and position of the nail T from the finger images including nail images of the nail T of the printing finger U1 which are obtained by the cameras 51 and obtains the outline as information represented by x and y coordinates and such like.

The nail information detecting unit 812 detects the outline (shape) of the nail T on the basis of the difference in color and such like between the nail T and the other finger portion from the finger images including nail images of the nail T of the printing finger U1 obtained by the cameras 51, for example. The method of detecting the outline (shape) of the nail T by the nail information detecting unit 812 is not especially limited, and not limited to the above examples.

The nail information detecting unit 812 detects the nail height of nail T on the basis of images of nail T photographed by the cameras 51. Here, the nail height is a position in vertical direction of nail T.

The nail information detecting unit 812 further detects the nail curvature of nail T having the curved shape curved along the width direction on the basis of the images of nail T photographed by the cameras 51. The nail curvature is a curvature of the curved shape in the width direction of nail T.

For example, the nail information detecting unit 812 can estimate the nail height and the nail curvature of the nail T from the change in shadow which appears in the nail images by photographing the nail T from the two different angles with the cameras 51.

The nail information detecting unit 812 classifies the arc level of nail into a plurality of levels based on the obtained nail curvature.

In a case where the nail information detecting unit 812 classifies the arc level into three levels, for example, the level having the smallest curvatures is level 1, the level having the largest curvatures is level 3, and the level having the intermediate curvatures is level 2.

The method for detecting the nail height and nail curvature of nail T by the nail information detecting unit 812 is not especially limited to the examples illustrated here.

The drawing data generation unit 813 generates data for the drawing to be performed on the nail T of the printing finger U1 by the print head 42 on the basis of the nail information detected by the nail information detecting unit 812.

Specifically, the drawing data generation unit 813 performs a fitting process by reducing, enlarging or such like the image data of the design image on the basis of the nail information such as the shape of the nail T detected by the nail information detecting unit 812, and generates drawing data of a design element for printing at least one design element to be arranged on the background design on the nail T.

The drawing data generation unit 813 also generates background data on the basis of the image data of design image. The background data is data of an image which is the background of the design element, and the background data is generated on the basis of the background design which is included in the image data and the entire region of which is a fill area.

The display control unit 814 controls the display unit 26 to display various types of display screens on the display unit 26. In the embodiment, the display control unit 814 makes the display unit 26 display a selection screen of design image, thumbnail images for design confirmation, finger images obtained by photographing the printing finger Ill, nail images included in the finger images, various instruction screens and such like, for example.

The drawing control unit 815 outputs the design element data and the background data generated by the drawing data generation unit 813 to the drawing unit 40, and controls operations of the X-direction movement motor 46 and the Y-direction movement motor 48 which are the head driving unit 49 of the drawing unit 40 and the solenoid 440 which moves the writing tool 41 up and down, so as to perform printing in accordance with the design element data and the background data on the nail T.

The background region setting unit 817 sets the entire nail region detected by the nail information detecting unit 812 as a background region.

The design region setting unit 816 sets, as a design region, the nail region detected by the nail information detecting unit 812 excluding partial regions at the both edge sides in the width direction.

Specifically, the respective portions over a predetermined length from the both ends in the width direction of the nail region are left and right edge portions, and the design region setting unit 816 sets, as the design region, the region obtained by excluding the both edge portions from the nail region.

Here, the width of each of the excluded edge portions along the width direction of nail region is determined to be an optimum value according to the shape and such like of the nail. The preferable width is a value within the range of 100 to 200 μm, for example.

The design region setting unit 816 determines the width of edge portion to be excluded according to the level of nail T curvature.

Specifically, for example, the width of edge portion is determined to be 100 μm, 150 μm and 200 μm for the nail T of level 1, level 2 and level 3, respectively.

Next, the operation of drawing apparatus 1 and the drawing control method in the embodiment will be described.

Figure 5:
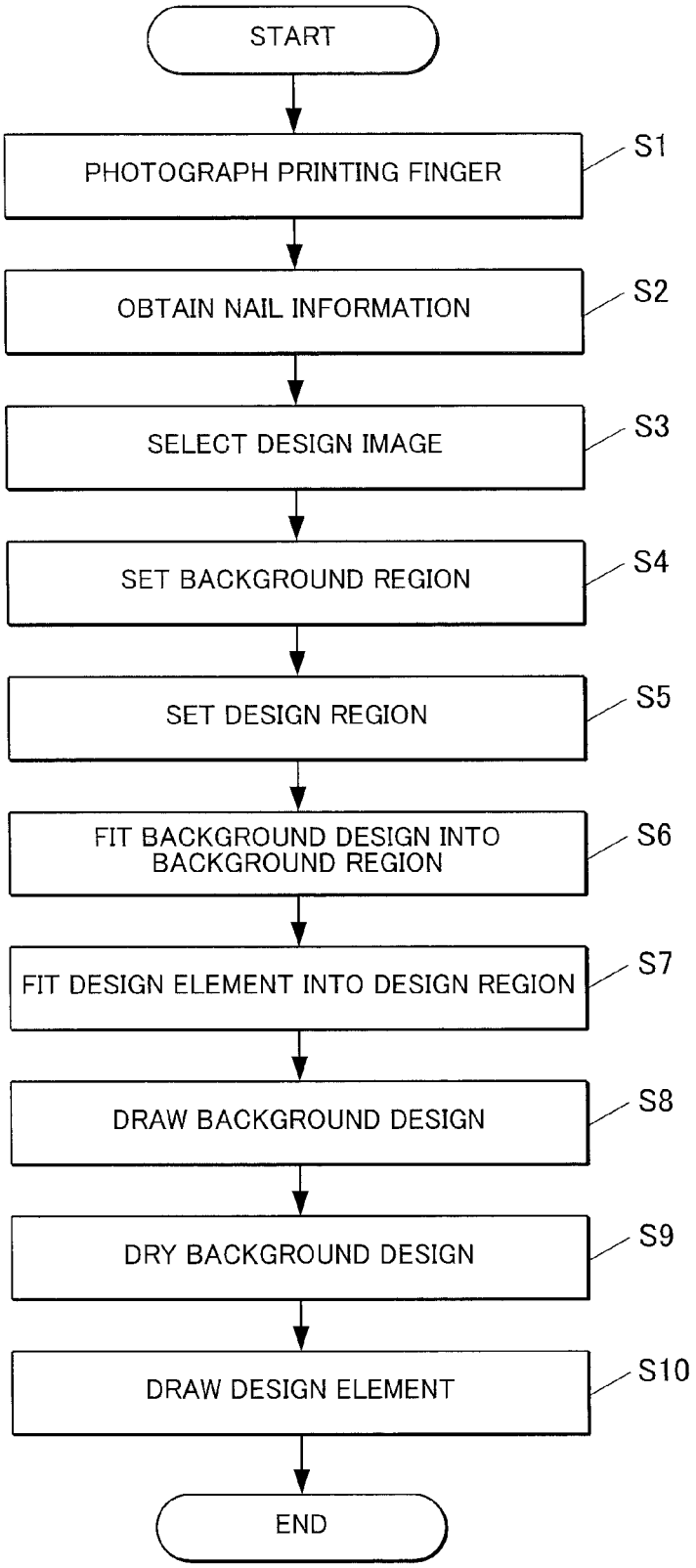
FIG. 5 is a flow chart showing the flow of a drawing control method according to the embodiment.

FIG. 5 is a flow chart showing the flow of drawing control method.

When printing is to be performed by the drawing apparatus 1, the user first turns on the power switch to activate the control device 80.

Next, the user inserts the printing finger U1 into the finger receiving unit 31, inserts the non-printing fingers U2 into the finger resting unit 32, fixes the printing finger U1, and then operates the print switch.

When an instruction is input from the print switch, before the print operation is started, the photographing control unit 811 first controls the photographing unit 50 to photograph the printing finger U1 with the cameras 51 while illuminating the printing finger U1 with the lights 52. Thus, the photographing control unit 811 obtains the finger images of the printing finger U1 inserted into the finger receiving unit 31 (step S1).

Next, the nail information detecting unit 812 detects (calculates) the outline (nail region) of nail T, the nail position (including vertical position of nail) and the nail curvature on the basis of the finger images to obtain the nail information (step S2).

Next, the display control unit 814 controls the display unit 26 to display the design selection screen. The user operates the operation unit 25 to select a desired design image from among a plurality of design images displayed on the design selection screen, and thus, the selection instruction signal is output from the operation unit 25 to select the design image to be printed on the nail T (step S3).

Figure 6A:
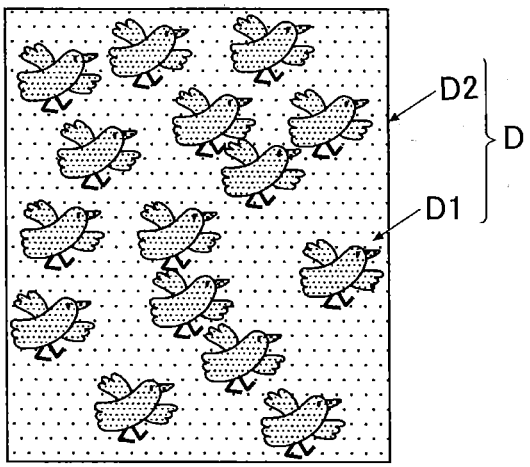
FIGS. 6A, 6B and 6C are explanation views showing examples of a design image according to the embodiment.
Figure 6B:
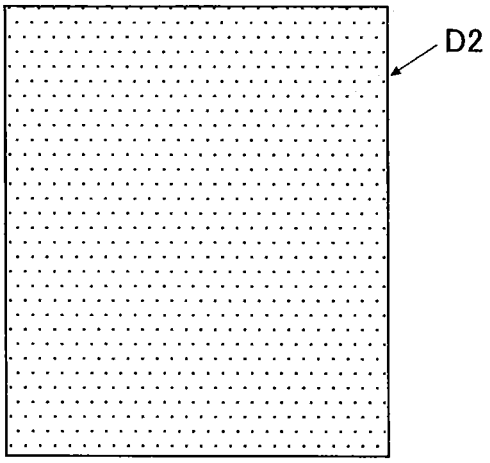
Figure 6C:
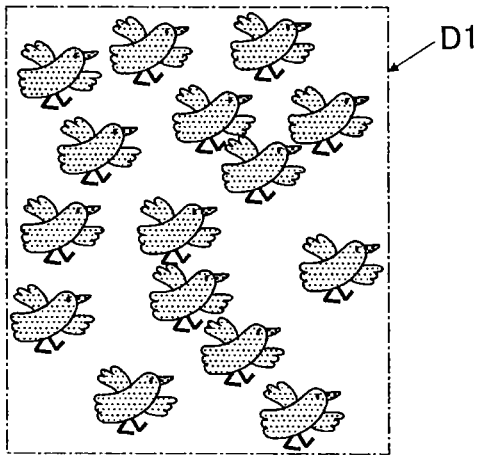

FIGS. 6A, 6B and 6C are explanation views showing examples of a design image. FIG. 6A shows the whole design image, FIG. 6B shows the background design thereof and FIG. 6C shows the design element thereof.

As shown in FIGS. 6A to 6C, the design image D includes a design element D1 formed of a plurality of characters representing a bird and a background design D2 which is the background of the design element D1 and the entire region of which is a fill area. The design element D1 and the background design D2 are unified to be generated as the image data.

When the nail information is detected by the nail information detecting unit 812, the background region setting unit 817 sets the entire nail region as the background region on the basis of the nail information (step S4).

Thereafter, the design region setting unit 816 sets, as the design region, the region obtained by excluding the both edge portions in the width direction from the nail region detected by the nail information detecting unit 812 on the basis of the nail information detected by the nail information detecting unit 812 (step S5).

At this time, the design region setting unit 816 determines the width of each of the edge portions to be excluded according to the level of nail T curvature.

Figure 7:
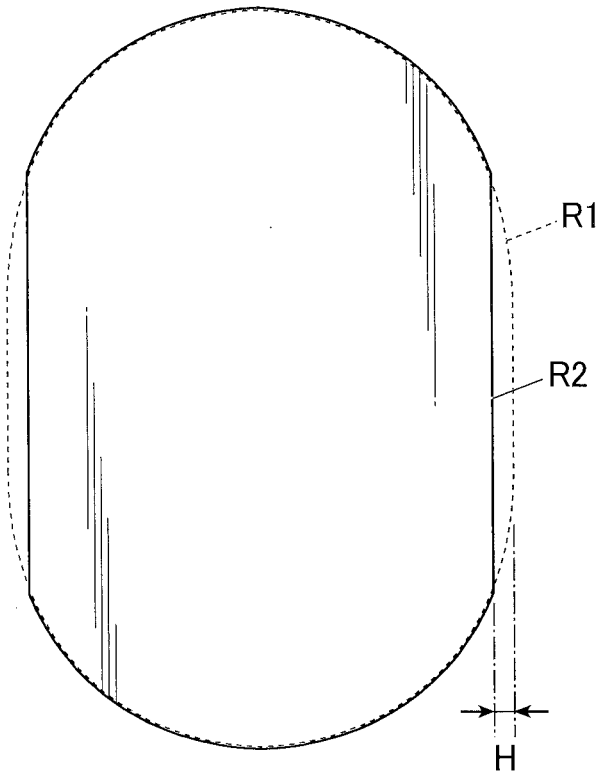
FIG. 7 is an explanation view which schematically shows a background region and a design region of a nail according to the embodiment.

FIG. 7 is an explanation view schematically showing a background region R1 and a design region R2 of the nail T.

As shown in FIG. 7, the background region R1 is indicated by dotted lines in the drawing and corresponds to the entire nail region.

On the other hand, the design region R2 is indicated by a solid line in the drawing, and corresponds to the region obtained by excluding the both edge portions in the width direction from the entire nail region. The reference H indicates the width of each of the excluded edge portions.

Next, the drawing data generation unit 813 processes the image data so that the background design D2 is fitted into the background region R1, and generates drawing data of the background design D2 (background data) (step S6).

The drawing data generation unit 813 processes the image data so that the design element D1 is fitted into the design region R2, and generates drawing data of the design element D1 (design element data) (step S7).

Figure 8A:
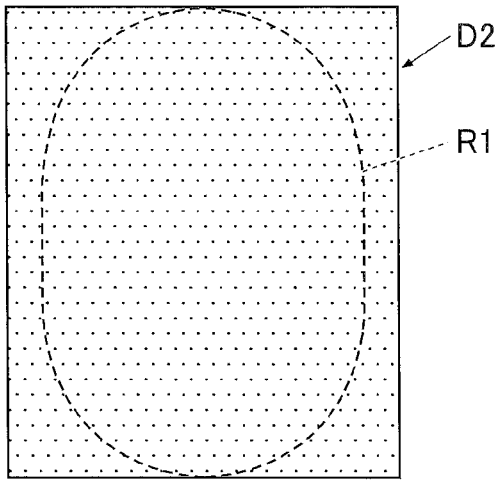
FIGS. 8A and 8B are explanation views showing images when respective designs are fitted to the respective regions according to the embodiment.
Figure 8B:
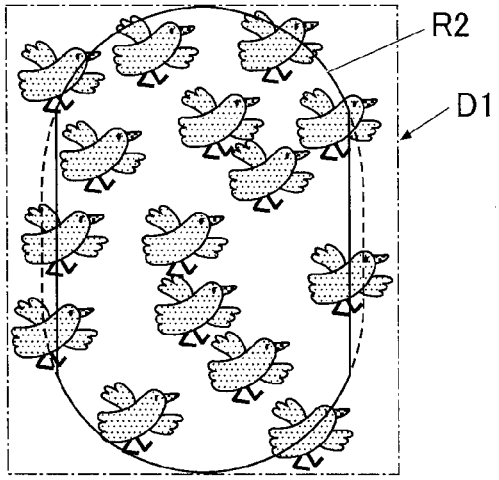

FIGS. 8A and 8B are explanation views showing images when the designs are fitted to the respective regions. FIG. 8A shows an image when the background design D2 is fitted to the background region R1, and FIG. 8B shows an image when the design element D1 is fitted to the design region R2.

As shown in FIG. 8A, the background design D2 is fitted to the background region R1 by superposing the background region R1 on the background design D2 in the image data and removing the portion protruding from the background region R1.

On the other hand, as shown in FIG. 8B, the design element D1 is fitted to the design region R2 by superposing the design region R2 on the design element D1 in the image data and removing the portion protruding from the design region R2.

Next, the drawing control unit 815 outputs the background design data to the drawing unit 40 and draws the background design D2 based on the background design data on the nail T (step S8). Specifically, the drawing control unit 815 drives the solenoid 440 to allow the writing tool 41 to perform drawing, operates the head driving unit 49 on the basis of the background design data and appropriately moves the writing tool 41 in the X and Y directions to perform drawing on the nail T. At this time, the writing tool 41 is pressed against the nail T surface by its own weight and performs drawing while moving up and down in accordance with the shape of nail T surface.

Next, the drawing control unit 815 temporarily stops the printing operation until the time for drying the background design D2 has elapsed (step S9). In the embodiment, the background design D2 is dried merely by the elapse of time; however, the background design D2 may be dried by providing a drying means such as a fan and driving the drying means, for example.

Furthermore, a UV light source may be used as the drying means in a case where the ink for the background design D2 is ultraviolet curable ink.

The drawing control unit 815 outputs the design element data to the drawing unit 40 and draws the design element D1 based on the design element data on the nail T (step S10).

Specifically, the drawing control unit 815 drives the solenoid 440 to allow the writing tool 41 to perform drawing, operates the head driving unit 49 on the basis of the design element data and appropriately moves the writing tool 41 in the X and Y directions to perform drawing on the nail T.

Figure 9:
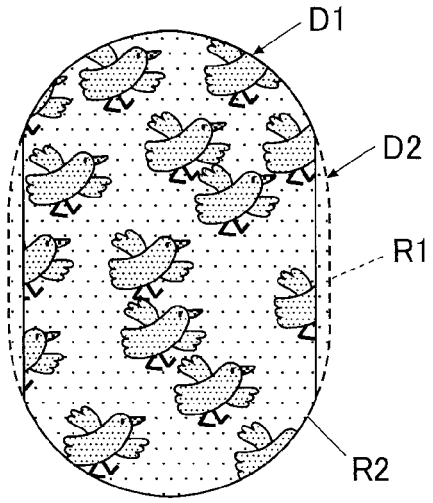
FIG. 9 is a schematic view showing a nail after drawing was performed.

FIG. 9 is a schematic view showing the state of nail T after the drawing was performed.

As shown in FIG. 9, the background design D2 is drawn on the entire nail T (nail region: background region R1), and the design element D1 is drawn on the region (design region R2) obtained by excluding the both edge portions in the width direction of nail T from the nail region.

When printing is completed, the drawing control unit 815 moves the print head 42 to be above a printing maintenance unit 60 and sets the writing tool 41 in the writing tool cap 62 to prevent the dry.

As described above, according to the embodiment, the background design D2 is arranged on the entire nail region and the design element D1 is arranged on the region obtained by excluding the both edge portions in the width direction of nail region from the nail region. Thus, the design element D1 which is finer than the background design D2 is not drawn on the both edge portions of the nail region. However, the width of each of the edge portions is approximately 100 to 200 μm, which is the very narrow region. Thus, the absence of design element D1 at the edge portions of the nail region is not so noticeable in appearance as long as the background is filled.

That is, by drawing the background design D2 and the design element D1 in such arrangement, the difference in appearance between the central portion and the both end portions in the width direction of the nail is suppressed.

Accordingly, it is possible to easily create designs without considering the difference between the central portion and the both end portions in the width direction of the nail.

Here, since the background region R1 and the design region R2 are set on the basis of the nail region detected from the finger images, it is possible to set the background region R1 and the design region R2 so as to successfully correspond to the actual shape of nail T.

The embodiment to which the present invention can be applied is not limited to the above-mentioned embodiment, and various changes can be appropriately made within the scope of the present invention.

For example, in the above embodiment, the design element D1 is arranged on the region obtained by excluding the both edge portions in the width direction of nail region from the nail region. However, the design element D1 may be arranged on a region obtained by excluding one edge portion in the width direction of nail region from the nail region.

For example, the above embodiment has been described by illustrating a case where the design element D1 and the background design D2 are included in the image data in advance. However, the configuration of the present invention can also be applied to image data formed of the design element only.

For example, in a case where the image data does not include the background design, the drawing data generation unit 813 creates the background design on the basis of the design element. Specifically, the drawing data generation unit 813 selects a background color which is appropriate for the contents of the design element and creates the background design data formed of the background color.

The method for selecting the background color includes a method of setting the background color to the color which is most used around the edges in the width direction of the design element D1, a method of setting the background color to be the color which is most used for the design element D1, a method of setting the background color to be the color which accentuates the color most used for the design element D1, and such like.

In a case where the drawing data generation unit 813 creates the background design, it is preferable to display only the background design or the unified background design and design element on the display unit 26 so that the user can confirm the background design and select another color.

The embodiment has been described by illustrating a plot type nail print apparatus as the drawing apparatus 1; however, the configuration of the present invention can also be used for ink jet type nail print apparatuses and hybrid type nail print apparatuses including the plot system and ink jet system.

Though several embodiments of the present invention have been described above, the scope of the present invention is not limited to the above embodiments, and includes the scope of inventions, which is described in the scope of claims, and the scope equivalent thereof.

What is claimed is:

1. A drawing apparatus, comprising:

a drawing data generation unit which, as a fitting process, fits a design image to a drawing region of a drawing target, and generates drawing data of the design image fitted to the drawing region; and a drawing unit which performs drawing of the design image on the drawing region on the basis of the drawing data, wherein the drawing region is curved along a width direction of the drawing region, wherein the design image comprises:

at least one design element; and a background design associated with the at least one design element, wherein the entire region of the background design is a fill area, wherein in a case where the drawing region is superposed over the at least one design element, a first portion of the at least one design element overlaps with an edge portion in the width direction of the drawing region, and a second portion of the at least one design element overlaps with a design region of the drawing region excluding the edge portion, and wherein the fitting process comprises:

removing the first portion of the at least one design element that overlaps with the edge portion of the drawing region; and fitting the background design to the entire drawing region.

2. The drawing apparatus according to claim 1, wherein the drawing data generation unit creates the background design on the basis of the at least one design element.

3. The drawing apparatus according to claim 1, further comprising:

an information detecting unit which detects a curvature degree in the width direction of the drawing region on the basis of an image obtained by photographing the drawing region; and a region setting unit which sets a width of the edge portion in the width direction of the drawing region on the basis of the curvature degree detected by the information detecting unit.

4. The drawing apparatus according to claim 1, wherein the drawing unit comprises a drawing tool which contacts the drawing target and performs the drawing on the drawing region.

5. The drawing apparatus according to claim 1, wherein the drawing unit comprises a print head which performs the drawing on the drawing region by an ink jet system.

6. A drawing control method of a drawing apparatus, the drawing control method comprising:

fitting, in a fitting process, a design image to a drawing region of a drawing target, and generating drawing data of the design image fitted to the drawing region; and controlling the drawing apparatus to draw the design image on the drawing region on the basis of the drawing data, wherein the drawing region is curved along a width direction of the drawing region, wherein the design image comprises:

at least one design element; and a background design associated with the at least one design element, wherein the entire region of the background design is a fill area, wherein in a case where the drawing region is superposed over the at least one design element, a first portion of the at least one design element overlaps with an edge portion in the width direction of the drawing region, and a second portion of the at least one design element overlaps with a design region of the drawing region excluding the edge portion, and wherein the fitting process comprises:

removing the first portion of the at least one design element that overlaps with the edge portion of the drawing region; and fitting the background design to the entire drawing region.

7. The drawing control method according to claim 6, wherein the generating of the drawing data comprises creating the background design on the basis of the at least one design element.

8. The drawing control method according to claim 6, further comprising:

detecting a curvature degree in the width direction of the drawing region on the basis of an image obtained by photographing the drawing region; and setting a width of the edge portion in the width direction of the drawing region on the basis of the curvature degree.

* * * * *